United States Patent [19]

Murphy

[11] Patent Number: 4,721,302

[45] Date of Patent: Jan. 26, 1988

[54] PUNCHING BAG AND SUSPENSION SYSTEM

[76] Inventor: Randy L. Murphy, 501 Linden Ave., Kinston, N.C. 28501

[21] Appl. No.: 852,646

[22] Filed: Apr. 16, 1986

[51] Int. Cl.[4] ..... A63B 69/00

[52] U.S. Cl. ..... 272/78; 272/76; 273/55 R; 273/55 A

[58] Field of Search ..... 272/76, 77, 78, DIG. 5, 272/136, 900, 110, 61, 55 R, 85, 87, 52, 52.5; 273/55 A

[56] References Cited

U.S. PATENT DOCUMENTS

| | | | |
|---|---|---|---|
| 689,344 | 12/1901 | Yoerger et al. | 272/78 |
| 1,586,899 | 6/1926 | Herring | 272/900 X |
| 3,337,217 | 5/1966 | Cummins | 272/76 |
| 4,088,315 | 5/1978 | Schemmel | 272/76 |

FOREIGN PATENT DOCUMENTS

| | | | |
|---|---|---|---|
| 0516092 | 12/1920 | France | 272/77 |

*Primary Examiner*—Richard J. Apley
*Assistant Examiner*—Howard Flaxman
*Attorney, Agent, or Firm*—Rhodes and Coats

[57] ABSTRACT

A punching bag specifically designed and constructed for use with a reaction time and applied force measuring device. An elongated bag is suspended between an overhead support and the floor. The punching bag is supported from the overhead support by a plurality of rope-like members which extend outwardly and acutely from the punching bag. The punching bag is secured to the floor by a rope-like member attached to the bag's bottom. The bottom rope-like member has slack such that the bag may swing within a confined radius. Additionally, springs may be included with the rope-like members and the support structures such that the reactionary force is enhanced.

10 Claims, 6 Drawing Figures

PUNCHING BAG AND SUSPENSION SYSTEM

FIELD OF INVENTION

The present invention relates generally to sports equipment devices and more particularly to punching bags.

BACKGROUND OF INVENTION

The fitness trend which has gripped America in the past decade has led to an increased demand for improved sports equipment of all kinds. The punching bag, which was once used almost exclusively to train boxers, is now commonly found in the homes of fitness conscious Americans and for good reason. The punching bag helps develop upper body strength and quickness which is beneficial in any athletic endeavor. Additionally, the aerobic effect of a "work-out" on the punching bag helps build stamina and strengthens the cardiovascular system.

Recently is has been proposed to apply electronic measuring devices to sports training equipment to provide a quantitative measure of the reaction time and applied force of the user. Such feedback training systems may be particularly useful in punching or body bags used in training boxers. The patent to Bigelow et al, U.S. Pat. No. 4,534,557, discloses one such reaction time and applied force feedback training system. The patent to Bigelow, however, emphasizes the electronic aspects of such feedback training systems and provides virtually no guidance as to the design and construction of the sports equipment which might be used in such systems.

Presently, there is no punching bag on the market which is specifically designed to be used in such feedback training systems. Such bags have unique design considerations to which prior art punching bags do not address. Accordingly, there is a need for a punching bag specifically adopted for use in conjunction with reaction time and applied force measuring devices of the type disclosed in Bigelowe et al.

SUMMARY AND OBJECTS OF INVENTION

The present invention provides a novel punching bag especially designed and constructed for use in connection with electronic measuring devices. The invention includes an elongated cylindrical bag having suspension means for interconnecting the upper end of the punching bag to an overhead support structure and retaining means for interconnecting the lower end of the punching bag to an underlying support structure.

The suspension means includes a plurality of flexible suspension members uniformly spaced and connected to the upper end of the punching bag. The suspension members extend upwardly and outwardly therefrom to where they connect with the overhead support structure. The retaining means includes at least one flexible suspension member and interconnects the lower end of the punching bag with the underlying support surface.

Both the suspension and retaining means positively limit the movement of the bag within a predetermined range. Additionally, the suspension and retaining means serve to impart a force to the bag resulting in a unique pattern of movement that simulates the movement of an actual opponent. This is accomplished by providing spring means in both the suspension and retaining means. More particularly, the spring means form a part of the flexible suspension members. When a force is applied to the bag, such as by striking the bag, the spring means will expand allowing the bag to move within a predetermined range. When the spring means contracts it thereby applies a force to the bag via the flexible suspension member.

Accordingly, it is an object of the present invention to provide a punching bag that is specifically designed and constructed for use in connection with electronic measuring devices.

Another object of the present invention is to provide a punching bag that is suspended in such a manner as to limit the range of movement of the bag to a predetermined area.

Another object of the present invention is to provide a punching bag, the movement of which resembles the movement of an actual opponent.

Another object of the present invention is to provide a punching bag which may be used in connection with electronic measuring devices to measure the reaction time and applied force of the user as well as to count the number of times the user strikes the bag in a given interval.

A further object of the present invention is to provide a unique suspension system for a punching bag that results in the punching bag actually simulating the movement of a boxer as it is hit.

Another object of the present invention is to provide a punching bag and suspension system therefore wherein the suspension system controls and limits the movement of the punching bag after it has been hit.

Still a further object of the present invention is to provide both an upper suspension system and a lower retention means for the punching bag.

Still a further object of the present invention is to provide a suspension system that actually imparts force to the punching bag and results in the movement of the punching bag being influenced by such force in response to the bag being moved a selected amount by impact from the user.

Other objects and advantages of the present invention will become apparent from a study and review of the following detailed description of the invention and the accompanying drawings.

DETAILED DESCRIPTION OF INVENTION

Figure 1:
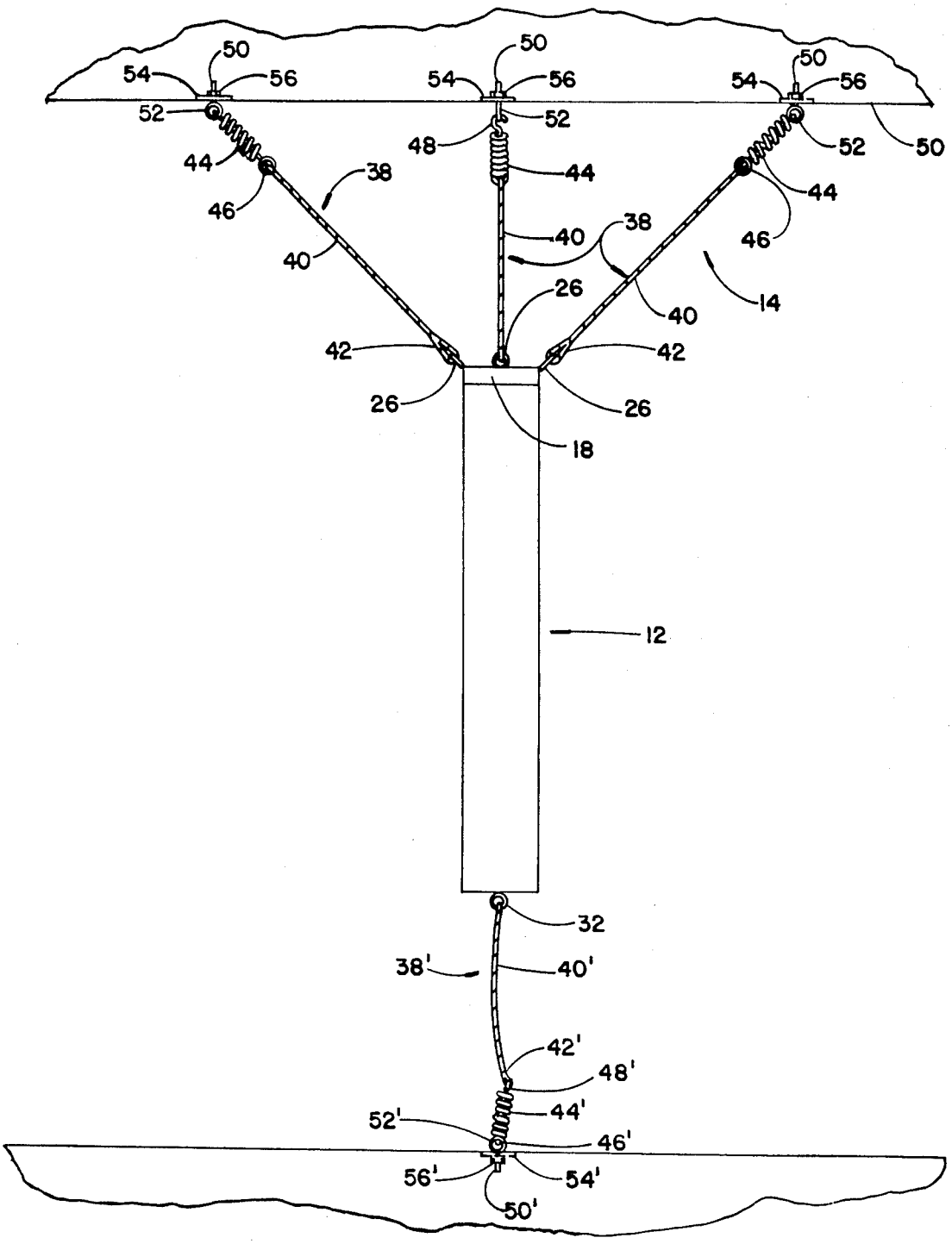
FIG. 1 is an elevational view of the improved punching bag of the present invention.

Referring now to the drawings the punching bag and associated suspension and restraining means of the present invention is shown therein and indicated generally by the numeral 10. The punching bag 10 includes a bag structure indicated generally at 12, suspension means indicated generally at 14, and restraining means indicated generally by 16. The improved punching bag 10 of the present invention may also be provided with a reaction time measuring device 58 or a multi-function electronic measuring device indicated generally at 70.

Figure 2:
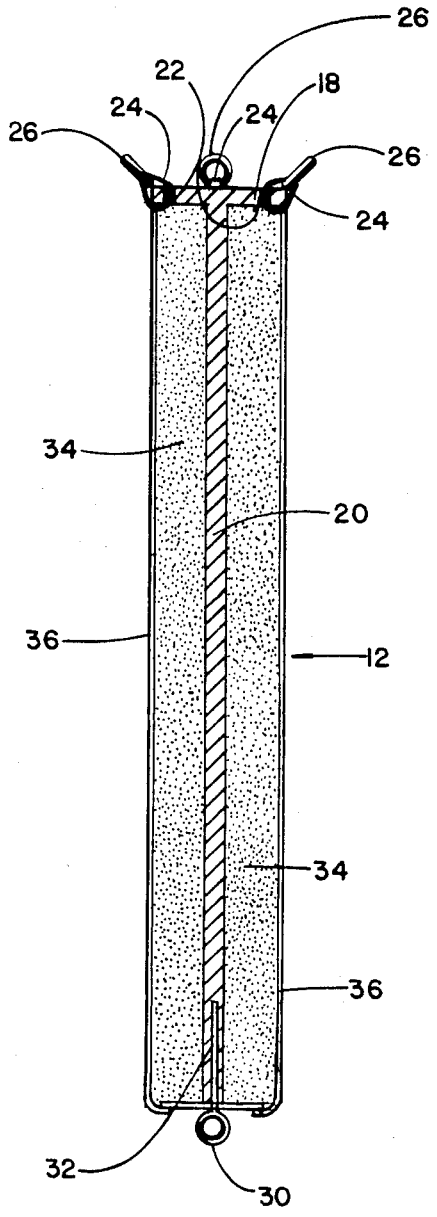
FIG. 2 is a longitudinal sectional view of the improved punching bag of the present invention illustrating the construction of the bag structure.
Figure 3:
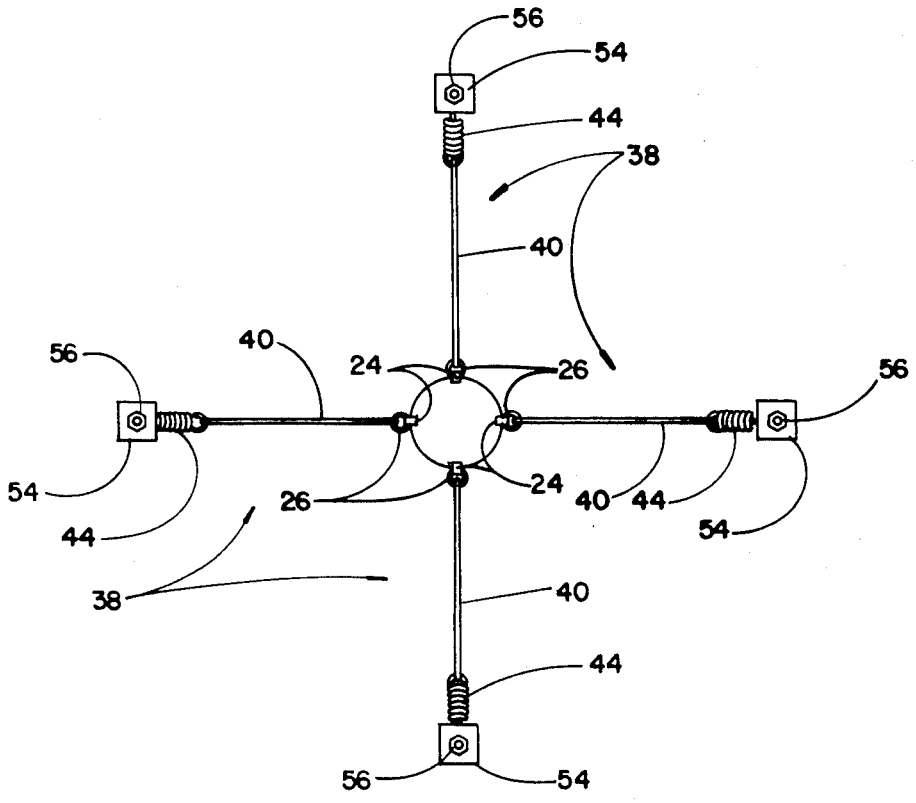
FIG. 3 is a top view of the punching bag of the present invention.

The bag structure 12 of the present invention has an elongated cylindrical configuration as can be clearly seen in FIGS. 1 and 3. Bag structure 12 includes a skeletal structure having an upper plate 18 and integrally formed core 20 extending downwardly from the center of upper plate 18. Upper plate 18 and core 20 are constructed of a semi-rigid material, preferably a hard rubber. Four slot-like openings 22 are formed in the upper plate 18 and are equally spaced around the perimeter thereof. A fabric loop 24 is threaded through each of the slot-like openings 22 and secures a metal ring 26 to the bag structure 12 as can be clearly seen in FIG. 2. A threaded bore 28 is provided in the lower end of core 20. A bolt 30 having an eyelet 32 is threaded into the bore 28 to provide means for restraining the lower end of bag 12 as will be described in greater detail below.

A padding material 34, such as foam, is tightly wound around core 20. A covering 36 is then wrapped around the circumference of the padding material 34 and folded under the bottom of bag structure 12 to fully enclose the padding material 34. The padding material 34 and covering 36 may be secured by an adhesive to form an integral structure with the upper plate 18 and core 20 or by any other suitable means.

Referring again to FIG. 1, it is seen that the bag structure 12 is suspended from at its upper end by a plurality of flexible suspension members 38. The suspension members 38 include a flexible rope-like member 40 which may preferably a plastic coated metal cable and an expandable member which may preferably be a tension coil spring 44. Tension coil springs 44 having a ring portion 46 and a hook portion 48. Flexible rope-like members 40 are secured to the upper end of bag structure 12 by forming a loop 42 at one end thereof which extends through a respective metal ring 26. Flexible rope-like members 40 are likewise secured at the other end to respective tension coil spring 44 by forming a second loop 42 at the opposite end which extends through the ring portion 46 of the tension coil spring 44.

Four bolts 50 having eyelets 52 are secured to an overhead support surface such as a ceiling and are arranged to form a square as can be clearly seen in FIG. 3. A reinforcing plate 54 is placed over the end of each bolt 50 and is secured by a nut 56 threaded onto the bolt until it firmly presses the reinforcing plate 54 against the top side of the overhead support surface as can be clearly seen in FIG. 1. To suspend the punching bag 10 of the present invention the hook portion 48 of each tension coil spring 44 are engaged with the respective eyelet 52 as can be clearly seen in FIGS. 1 and 3.

Once the upper end of the bag structure 12 is suspended in the manner described above, the lower end of the bag structure 12 is interconnected with an underlying support surface such as the floor by the restraining means 16. In the preferred embodiment the restraining means 16 comprises a single flexible suspension member 38' identical to those used to suspend the bag structure 12 from the overhead support surface. The suspension member 38' is secured to the lower end of the bag structure 12 by forming a loop 42' in the free end of the flexible rope-like which extends through the eyelet 32. A fifth bolt 50' having an eyelet 52' is secured to the underlying support structure in the same manner as described above at a point directly below the suspended bag structure 12. The hook portion 48' of the tension coil spring 44' engages the eyelet 52' thereby positively limiting the range of movement of the lower end of the bag structure 12 within a circular area the size of which will depend on the length of the suspension member 38.

To use the punching bag 10 of the present invention the same is suspended between the overhead support structure and underlying support structure as described above. It is appreciated that the manner for suspending the bag 10 is relatively simple to use so that bag 10 can be easily and quickly set-up for a "work-out". Once the "work-out" is complete the bag 10 can just as easily be removed and stored in a closet or the like.

The punching bag 10 of the present invention is used in the same manner as a conventional punching bag. The movement of the bag however is unique. In particular, once the bag structure 12 is struck it will move in the direction away from the force of the blow within the area permitted by the suspension and restraining means. The allowable range of movement of the upper end of the bag structure 12 will of course be smaller than the allowable range of movement of the lower end of the bag structure 12. The bag will continue to move in the direction away from the force of the blow until the suspension members 38 are pulled taut at which time the tension coil springs 44 will expand. When the tension coil springs 44 begin to retract or compress they will pull on the flexible rope-like members 40 thereby imparting a force to the bag 10 in addition to the impact from the blow. The expansion and compression of the various tension coil springs 44 results in a random movement of the bag 10 within the predetermined range which simulates to some extent the movement of an actual opponent.

Figure 4:
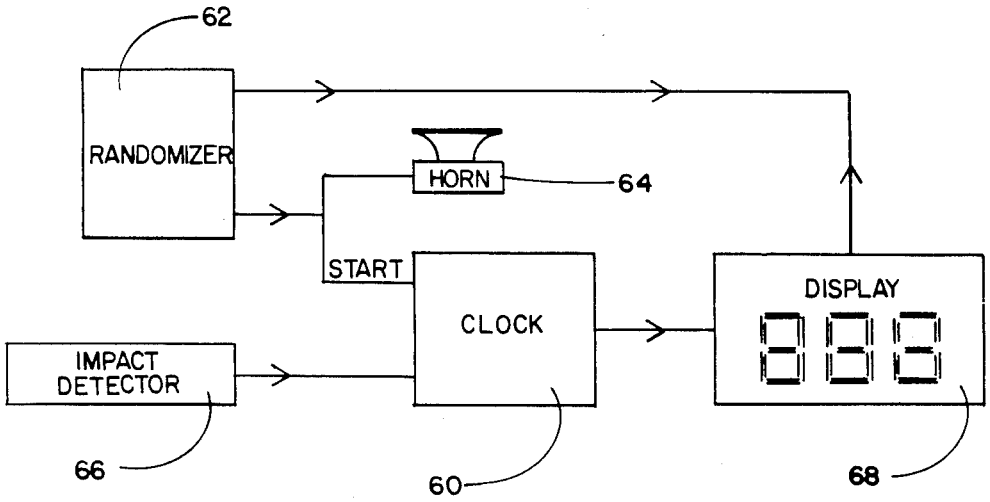
FIG. 4 is a schematic diagram of a reaction time measuring device used in conjunction with the improved punching bag of the present invention.
Figure 5:
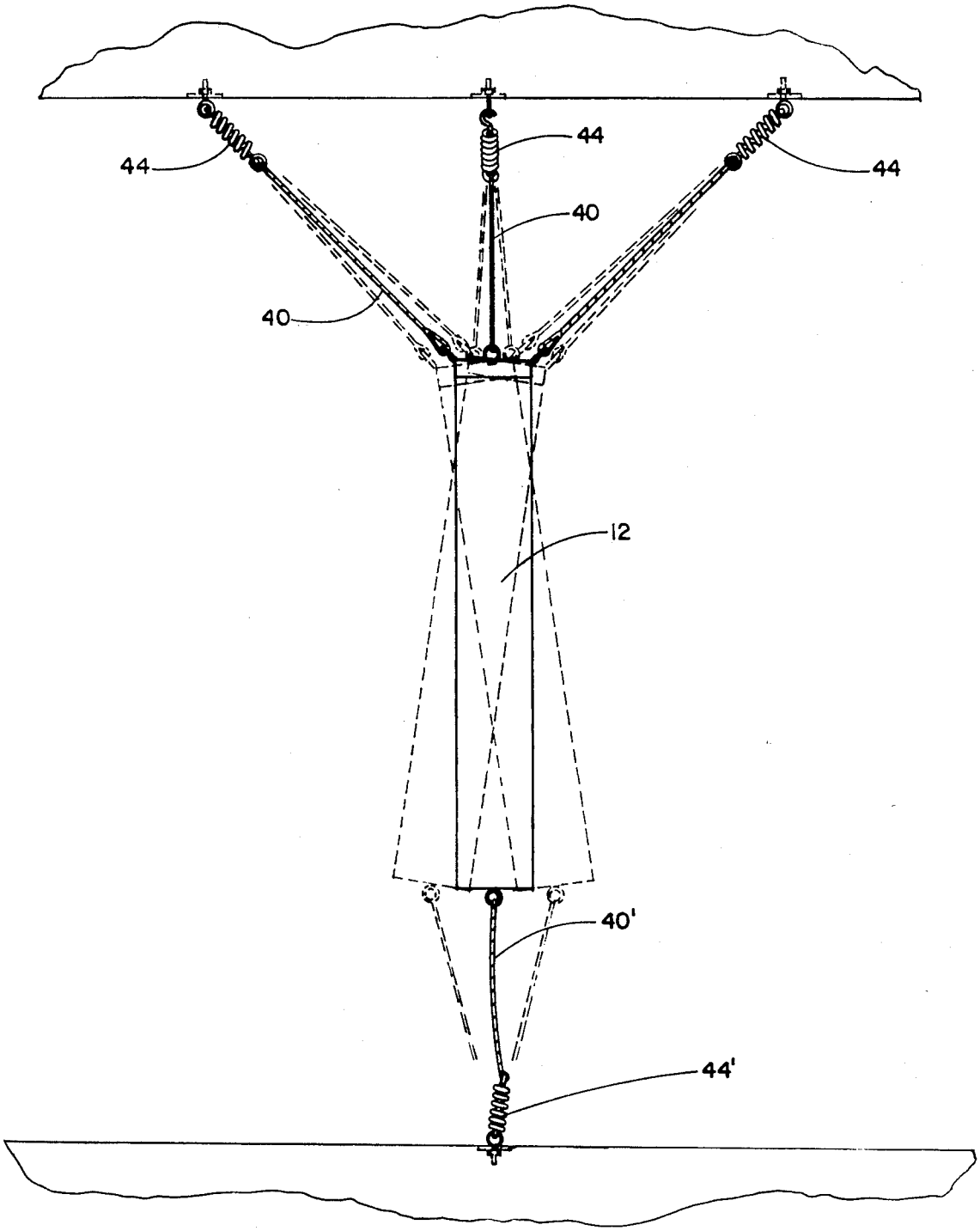
FIG. 5 is an elevational view illustrating the unique movement of the punching bag of the present invention.
Figure 6:
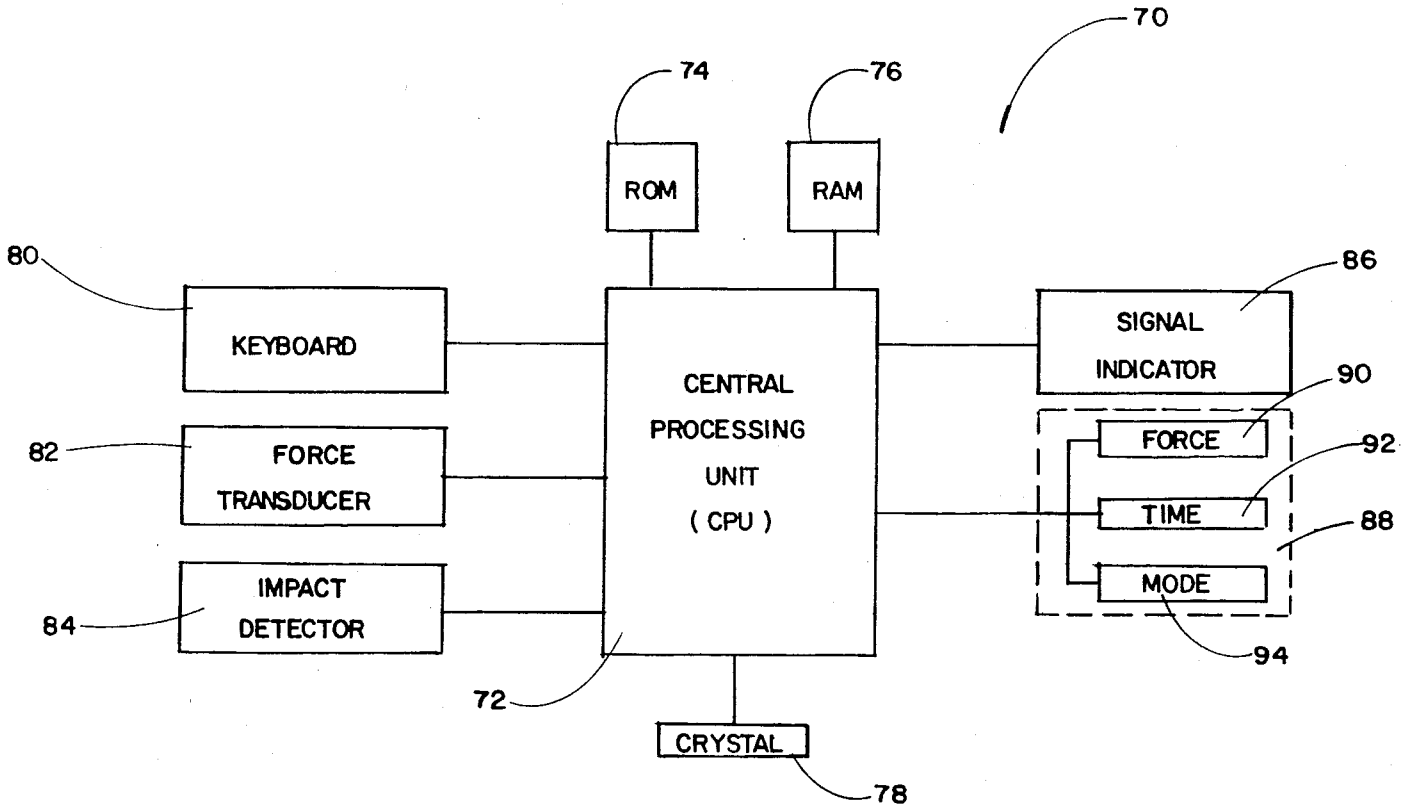
FIG. 6 is a schematic diagram of a multi-function electronic measuring device used in connection with the improved punching bag of the present invention.

The design of the punching bag 10 and associated suspension and restraining means makes it particularly suitable for use with electronic measure devices. Referring now to FIG. 4 a reaction time measuring device 58 is illustrated schematically. The reaction time measuring device 58 includes a clock unit 60 having two inputs and a single output. A randomizer 62 is communicatively connected to one input of clock unit 60 as well as to a horn 64. The randomizer 62 produces a "start clock" signal at random or pseudo-random intervals which causes the horn 64 to emit an audible turn and which indicates to the clock unit to start measuring time. The "start clock" signals vary in proportion to the "response time" as will be described below. An impact detector 66 is directly mounted on the punching bag and operatively connected to the second input from clock unit 60. The impact detector 66 produces a "stop clock" signal at the moment of impact which indicates to the clock unit 60 to stop measuring time. The clock unit 60 computes the interval of time between the "start clock" signal and the "stop clock" which is called the "response time." A display 68 is operatively connected to the output of the clock unit 60 and displays the "response time" obtained from the clock unit 60. The response time is then conveyed to the randomizer 62 which uses the same to produce the next "start signal", which as stated above varies proportionately with the "response time".

A multi-function measuring device 70 may be used in lieu of the single purpose reaction time measuring device 58 described above. The heart of the multi-function measuring device 70 is the central processing unit (CPU) 72 which is nothing more than a single-chip microcomputer. The CPU can be programmed to carry out the variety of functions which will be described in detail below. The CPU contains a read-only-memory (ROM) 74 for storing programs and a random access memory (RAM) 76 which acts as a scratch pad for making calculations and for storing variables. The CPU further includes a crystal clock reference 78 for keeping time.

The CPU has three input ports and two output ports. A keyboard 80 is operatively connected to the first input port and permits the user to key in the desired mode of operation and other relevant parameters. A force transducer 82 which is mounted on the bag structure 12 is operatively connected to the second input port. The purpose of the force transducer 82 is to measure the applied force to the bag 12 and to provide a signal which can be understood by the CPU. An impact detector 84 is also mounted on bag structure 12 and is operatively connected to the third and last input port. The impact detector 84 detects each time the bag is struck and produces a signal which may be treated by the CPU in a variety of manners depending on the mode of operation.

A signal indicator 86, which may be audible or visual, is operatively connected to one output port of the CPU. The second output port is operatively connected to a display 88 having separate LED readouts for displaying force 90, reaction time 92 and mode of operation 94.

To use the multi-function measuring device 70 the user keys in the desired mode of operation which is read by the CPU. The CPU then selects the appropriate instruction set corresponding to the selected mode which is displayed on the display 88. If the user has selected the reaction-time measuring mode the CPU will all a random interval of time produce a "start signal" which will cause the signal indicator 86 to flash a light or sound a horn as the case may be. The user will then strike the bag 10. The impact detector, as a result will produce a "stop signal" which indicates to the CPU to stop measuring time. The CPU computes the "response time" by measuring the interval between the "start signal" and the "stop signal" and causes the result to be displayed on the appropriate LED on the display 88.

If the user selects the counting mode he or she must also key in the desired interval of time over which the CPU is to count. The CPU will then produce a "start signal" which will cause the signal indicator 86 to either flash a light or sound a horn. The user then strikes the bag continuously until the light flashes or the horn sounds for a second time. After the selected interval of time has elapsed the CPU will again cause the signal indicator to flash a light for example and will display the number of time in which the bag was struck during the selected interval.

A third mode of operation is referred to as the applied force mode. In this mode the CPU does not generate a "start signal" but merely waits until the user strikes the bag. The force transducer 82 will measure the force and produce a signal that can be understood by the CPU which in turn will display the "applied force" in the appropriate LED in the display 88.

From the foregoing, it is seen that the present invention provides an improved punching bag which similates the body movement of an actual opponent and which provides a quantitative measure of the athletic ability of the user.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A punching bag and suspension and mounting system therefore, comprising: an elongated punching bag having both a top and a bottom; a plurality of equally spaced attachment means directly secured the top of said punching bag; upper connecting means for suspending said punching bag from an overhead support structure; said upper connecting means consisting of a plurality of equally spaced flexible rope-like members having lower ends connected directly to the attachment means and upper ends connected directly to the overhead support structure; each flexible rope-like member extending acutely and outwardly from the punching bag such that the punching bag is suspended inwardly from the various points of connections of each flexible rope-like member with the overhead structure; means for controlling the movement of the lower portion of said punching bag in response to punches being absorbed by the punching bag, said control means including means for limiting the movement of the lower portion of said punching bag outside of a selected area but allowing the lower portion of said punching bag to freely and randomly move within that selected area; and said control means including a flexible rope like retainer normally loosely connected directly to the lower portion of said punching bag and extending therefrom where said flexible rope like retainer is connected to an underlying structure.

2. The punching bag and suspension and mounting system of claim 1 wherein said flexible rope-like retainer includes means for generating and imparting a reaction force to said punching bag as the same randomly moves in response to punches being landed there against, said reaction force means including spring means forming a part of said flexible rope-like retainer and disposed between said punching bag and said underlying support.

3. The punching bag and suspension and mounting system of claim 2 wherein each flexible rope-like member of said upper connecting means includes a spring and wherein said spring is interposed between an outer remote end of each flexible rope-like member and said overhead support structure.

4. The punching bag of claim 1 including impact sensing means implanted within said bag and means operatively connected to said impact sensing means for determining the number of times a subject strikes said bag during a selected time interval.

5. The punching bag of claim 1 including impact sensing means implanted within said bag and means operatively connected to said impact sensing means for emitting a signal and determining the reaction time between the time the signal is emitted and impact with said bag.

6. A method of suspending and mounting a punching bag to realistically simulate the random movement of an actual boxing opponent comprising the steps of: suspending an elongated punching bag from an overhead support; said punching bag having a top and bottom wherein said top is suspended from the overhead support; said punching bag also having a plurality of equally spaced attachment means secured directly to the top of said punching bag; positively confining and restricting the movement of the lower portion of the punching bag to a selected underlying area such that as the punching bag is hit the lower portion thereof is free to randomly move within the selected underlying area does not move outwardly thereof; the step of suspending the punching bag consisting of coupling a plurality of flexible rope-like members; directly to the attachment means and extending each flexible rope-like member outwardly and acutely from the punching bag and connecting the flexible rope-like member to the overhead support at points disposed outwardly of the punching bag such that each flexible rope-like member has a horizontal and vertical component; and said step of confining and restricting the movement of the lower portion of said punching bag including tying loosely connecting flexible rope like member between a lower portion of said punching bag and an underlying support structure such that the lower portion of said punching bag can randomly and freely move within the selected area of movement but because of the presence of the flexible rope like member is prohibited from moving outside of the selected area.

7. The method of claim 6 including the step of interposing a spring between the lower portion of said punching bag and said underlying support and operatively connecting said flexible like members to said spring such that as the bag is hit and moves outwardly the spring may stretch and then compress and wherein as the spring compresses the force thereof is transmitted to said punching bag thereby influencing the repounding movement of the punching bag.

8. The method of claim 7 including the step of connecting a spring to each flexible like member suspending the upper portion of said punching bag and operatively connecting each spring between the upper portion of said punching bag and said overhead support such that said springs effectively suspend the punching bag from said overhead support.

9. The method of claim 8 including inserting an elongated at least semi-rigid bar longitudinally through a substantial portion of said punching bag so as to maintain a degree of vertical rigidity through a substantial heighth of the punching bag when the same is vertically suspended.

10. A punching bag and suspension system for suspending the punching bag between an overhead structure and a floor area comprising: an elongated generally cylindrical punching bag that normally assumes a centered and vertical orientation; said elongated punching bag including a top, a bottom, and a surrounding cylindrical wall with the cross sectional area of the punching bag being generally uniform from the top to the bottom; a plurality of equally spaced attachment means directly secured to the top of said punching bag; an upper connecting means consisting of a plurality of flexible rope like members directly connected to the top of the punching bag and extending outwardly and acutely from attachment means to where each flexible rope attaches to the overhead structure; said plurality of flexible rope like members being generally equally spaced and extending substantially outwardly and acutely from the top of the punching bag such that each flexible rope has a horizontal and vertical component and wherein each flexible rope attaches to the overhead structure at a point substantially outwardly from the bag; each flexible rope being arranged and oriented relative to the bag and overhead structure so as to impart a positive reacting force to the punching bag in response to the punching bag being impacted and the bottom thereof moving outwardly in the general direction of the respective flexible rope, the positive reaction force being a force that causes the bottom of the bag to move back towards its normal centered and vertical position; a bottom flexible rope like member attached between the bottom of the punching bag and floor area; and wherein the bottom flexible rope like member assumes a substantially slack posture when the punching bag assumes the normal centered and vertical position, but wherein the bottom flexible rope is of a selected length so as to restrict and limit the movement of the bottom of the punching bag relative to its normal centered and vertical position.

* * * * *